US005409805A

United States Patent [19]

Haraguchi et al.

[11] Patent Number: 5,409,805

[45] Date of Patent: Apr. 25, 1995

[54] SOLID PROCESSING AGENT FOR SILVER HALIDE PHOTOGRAPHIC LIGHT-SENSITIVE MATERIALS

[75] Inventors: Tsuyoshi Haraguchi; Hiroaki Kobayashi, both of Tokyo, Japan

[73] Assignee: Konica Corporation, Tokyo, Japan

[21] Appl. No.: 274,841

[22] Filed: Jul. 14, 1994

[30] Foreign Application Priority Data

Jul. 29, 1993 [JP] Japan ..... 5-188421

[51] Int. Cl.[6] ..... G03C 5/00; G03C 7/00

[52] U.S. Cl. ..... 430/449; 430/372; 430/373; 430/455; 430/458; 430/460; 430/461; 430/463; 430/464; 430/465; 430/468

[58] Field of Search ..... 430/372, 373, 393, 449, 430/455, 458, 460, 461, 463, 464, 465, 486

[56] References Cited

U.S. PATENT DOCUMENTS 2,482,546 9/1949 Kaszuba .
2,494,903 1/1950 Sheidler .
2,596,926 5/1952 Gunther et al. .
2,610,122 9/1952 John et al. .
3,128,182 4/1964 Bard et al. .
3,128,183 4/1964 Jones et al. .
3,253,919 5/1966 Beavers et al. .
3,287,124 11/1966 Green et al. .
3,287,125 11/1966 Green et al. .
3,329,034 7/1967 Welsch et al. .
3,532,501 10/1970 Mackey et al. .
3,582,346 6/1971 Dersch .
3,813,247 5/1974 Minsk et al. .
4,119,462 10/1978 Hodes .
4,230,796 10/1980 Gunther et al. .
5,055,384 10/1991 Kuhnert ..... 430/458
5,135,840 8/1992 Reuter et al. ..... 430/465
5,258,268 11/1993 Reuter et al. ..... 430/465

*Primary Examiner*—Hoa Van Le
*Attorney, Agent, or Firm*—Finnegan, Henderson, Farabow, Garrett & Dunner

[57] ABSTRACT

A solid processing agent for a silver halide photographic light-sensitive material is disclosed, which comprises a compound represented by the following Formula (I):

Formula (I)

wherein $R_1$ represents a halogen atom, an alkyl group or an alkenyl group, provided that a plural of $R_1$'s may be the same or different; $R_2$ represents a halogen atom, an alkyl group, an alkenyl group or an alkoxy group; $R_3$ represents a lower alkyl group, provided that $R_1$, $R_2$ and $R_3$ may be the same or different, m and n each represent an integer of 0 to 5; and X represents an anion.

10 Claims, No Drawings

SOLID PROCESSING AGENT FOR SILVER HALIDE PHOTOGRAPHIC LIGHT-SENSITIVE MATERIALS

FIELD OF THE INVENTION

The invention relates to a processing composition for a silver halide photographic light-sensitive material, and particularly to a solid processing composition for a silver halide photographic light-sensitive material having high strength and excellent lubricity and having no adverse affect on the light-sensitive materials, wherein no scrathes occur on the surface of the light-sensitive materials and no stains occur on the rollers of the automatic developing machine during processing.

BACKGROUND OF THE INVENTION

A silver halide photographic light-sensitive material is photographically processed through a development step, a bleaching step, a fixing step, a washing step and/or a stabilization step after being exposed; a color paper light-sensitive material is photographically processed through a development step, a bleach-fixing step (bleaching, fixing), a fixing step, a washing step and/or a stabilization step after being exposed; and a black-and-white light-sensitive material is photographically processed through a development step, a fixing step and a washing step after being exposed. A reversal light-sensitive material is subjected to a reversal process in addition to the above steps.

Recently, photographic processing is ordinarily conducted using an automatic developing machine (hereinafter also referred to an automatic processor) equipped with tanks containing the processing solution through which the light-sensitive material is transported.

On such occasions, a replenisher replenishing system is commonly used wherein the processing solution in a processing tank is controlled so that the activity thereof is kept constant. Because of solution replenishing, much overflow-solution is ordinarily discharged.

The replenisher solution is composed of various elements (hereinafter referred to part agent or parts agents) to give excellent photographic properties during the photographic processing. These parts agents, if in contact with each other, react or deteriorate over a long time and the photographic processing capability is reduced. There are many compounds in photographic processing agents which readily react by an oxidation reduction reaction. Therefore, the processing agents are composed of elements separated in one or two or more parts agents as kits and these agents are dissolved in a fixed amount of water when employed.

The kits of the above parts agents are placed in vessels such as bottles and packages and these are placed in cases such as cardboard boxes and these boxes are put on sale as single units.

Recently, in Europe and America, environmental protection and resource saving are strongly demanded. In the photographic field polymer vessels used for the processing agents are a problem. The photographic polymer vessels are inexpensive, well suited for storage and transport, and excellent in chemical resistance, but the empty vessels are buried, discarded or burned as waste. However, the vessels pile up since they do not degrade biologically, and when burned, much carbon dioxide is generated resulting in the earth's temperature elevation. The users also have problems in that the empty polymer vessels accumlate in the narrow operation spaces to make the spaces narrower.

Further, world wide movements for regulation on prohibiting dumping the photo-effluents into oceans have been increased, and development of a new system in which photographic waste solution is markedly reduced and eventually eliminated is demanded.

In mini-labs which have recently proliferated rapidly, errors frequently occur during dissolution or dilution operations of the replenishing solutions due to a lack of man power, and this conventional replenishment system has drawn many frequent complaints.

Accordinly, in the photographic industry a new replenishing system is demanded in which photographic waste solution is markedly reduced, bottles for processing agents are eliminated and dissolving operations are also eliminated.

In response to these demands Japanese Patent O.P.I Publication No. 5-119454/1993 discloses a method of tableting almost all processing components and directly supplying tablets in processing tanks. Japanese Patent O.P.I Publication No. 4-213454/L992 discloses a method of providing specific powdered processing agents individually into automatic processors, and directly supplying them in the processing tanks after weighing the necessary amounts. Further, Japanese Patent O.P.I Publication No. 2-109042/1990 discloses a method of using a granulated processing agent. These references are common in disclosing the use of a solid chemical instead of the conventional liquid processing agent. However, the preceding two Patents disclose directly supplying the solid processing agent in processing tanks, and the last one discloses dissolving the solid processing agent to obtain replenishing solutions.

In order to produce a solid processing agent such as a granulated processing agent, processing agents are pulverized, granulated adding water and then dried to obtain a granulated processing agent. Tablets can be produced by compressing and molding the granulated processing agent or a powdered processing agent. The above references disclose the tablet production in this manner.

When powder or granules are compressed and molded to obtain a tablet, it is well known that lubricants are used in order to prevent molding difficulties due to friction between powder particles or between powder and the tableting machine. As a lubricant, magnesium stearate or talc is well known for use of a tablet of medicine.

However, the above described lubricants have the advantage of excellent lubricity, but another disadvantage is a decrease of the strength of the photographic processing tablet.

When solid processing photographic tablets containing the above lubricant are dissolved and a silver halide photographic light-sensitive material is processed with the solution, there occur scratches or stains on the light-sensitive materials, stains on the rollers of an automatic developing machine, and precipitates or floating matter in the processing tank, resulting in clogging problems of the circulating tubing.

A method of using a large amount of a lubricant are generally employed in order to improve lubricity, however, this results in an adverse affect on the photographic properties as well as the foregoing precipitates problems. Therefore, compounds which are used in even a small amount and effective have been demanded.

SUMMARY OF THE INVENTION

An object of the invention is to provide a processing composition for a silver halide photographic light-sensitive material having high strength and excellent lubricity, wherein during processing there occur no adverse affect on the light-sensitive material, no scrathes on the surface of the light-sensitive material, no stains on the rollers of an automatic developing machine and less precipitates in a fixer, bleach-fixer or stabilizer tank.

DETAILED DESCRIPTION OF THE INVENTION

The above object of the invention can be attained by a processing composition for a silver halide photographic light-sensitive material wherein the composition comprises a photographic processing agent and a compound represented by the following Formula (I):

Formula (I)

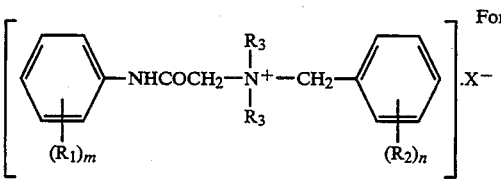

wherein $R_1$ represents a halogen atom, an alkyl group or an alkenyl group, provided that a plural of $R_1$'s may be the same or the different; $R_2$ represents a halogen atom, an alkyl group, an alkenyl group or an alkoxy group; $R_3$ represents a lower alkyl group, provided that $R_1$, $R_2$ and $R_3$ may be the same or different; m and n each represent an integer of 0 to 5; and X represents an anion. The lower alkyl group in the invention refers to an alkyl group having 1 to 3 carbon atoms, preferably 1 to 2 carbon atoms and most preferably 2 carbon atoms.

The composition of the invention is preferably a processing composition for a silver halide photographic light-sensitive material comprising a compound represented by the above Formula (I), wherein the composition is a solid composition, the content of the compound is $5\times10^{-6}$ to 4.0% by weight, the solid is in the form of a granule or tablet, the compound is localized on the surface of the granule or tablet, and the composition comprises a p-phenylenediamine or hydroquinone developing agent.

The present inventors have made an extensive study on various compounds, and have found that in the solid composition for a silver halide photographic light-sensitive material comprising a compound represented by the above Formula (I), the compound maintains tablet strength, gives excellent lubricity in powder, granule or tablet form, and has no adverse affect on photographic properties. This compound is usually used a bitterness agent, and therefore, the composition of the present invention using this compound as a lubricant is preferable since it has an additional effect that is safe if accidentally eaten or drunken.

In Formula (I), the halogen atom includes chlorine, bromine or iodine; the alkyl group includes preferably a lower alkyl group such as a methyl, ethyl or propyl group; the alkoxy group includes a methoxy, ethoxy or propoxy group; the alkenyl group includes a vinyl or allyl group; the anion group represented by $X^-$ represents a halogen ion such as chrolide, bromide or iodide, an inorganic anion such as sulfate, nitrate or perchlorate, a hydroxy anion, and an acid anion such as an aliphatic or aromatic carboxylic acid or a sulfonic acid. The substituent represented by $R_1$ is preferably positioned at the ortho of a —NH group. It is specially preferable that $R_1$ and $R_2$ each represent a methyl group, an ethyl group or a propyl group. $X^-$ is preferably an aromatic corboxylate anion, m is preferably an integer of 1 or 2 and n is preferably an integer of 0 or 1.

The exemplified compounds represented by Formula (1) will be shown below.

I-1

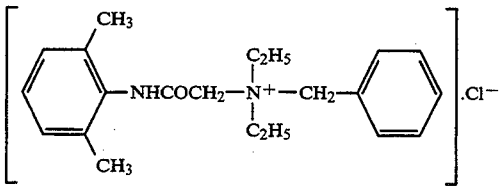

I-2

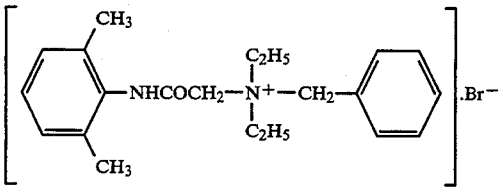

I-3

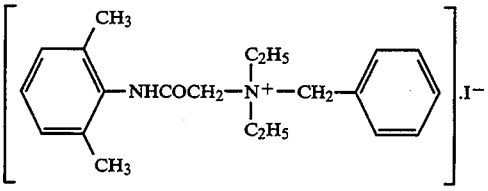

-continued
I-4
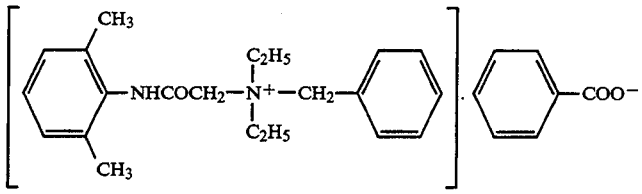
I-5
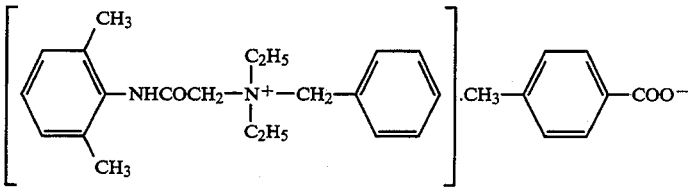
I-6
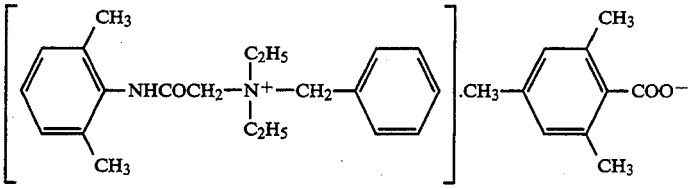
I-7
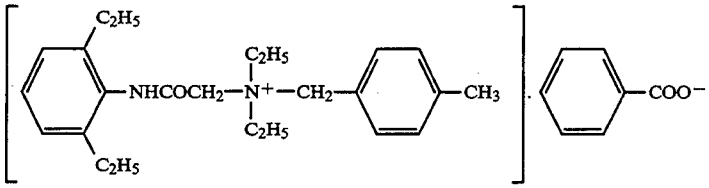
I-8
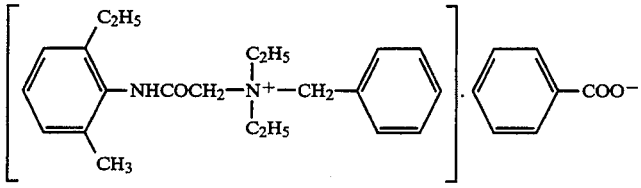
I-9
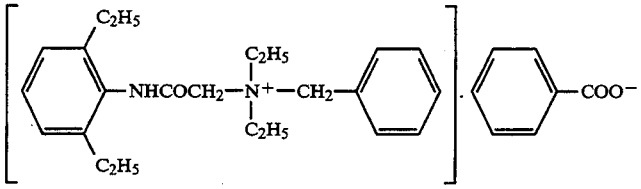
I-10
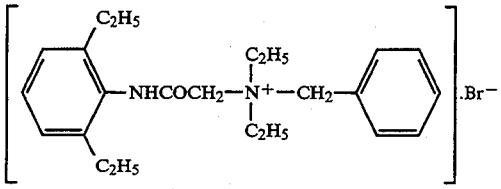
I-11
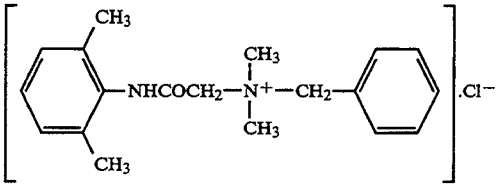

-continued

I-12

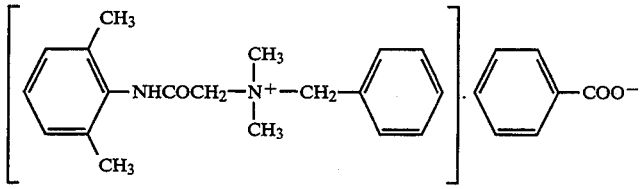

I-13

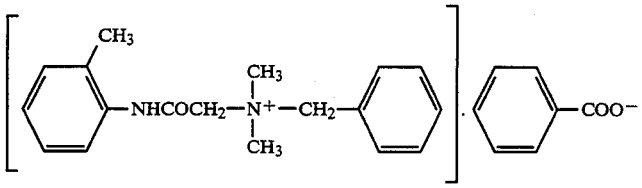

I-14

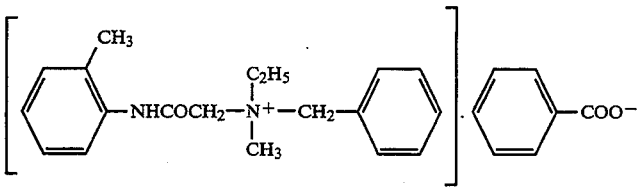

I-15

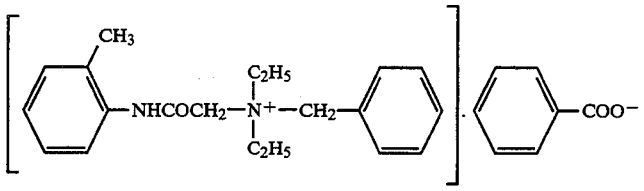

I-16

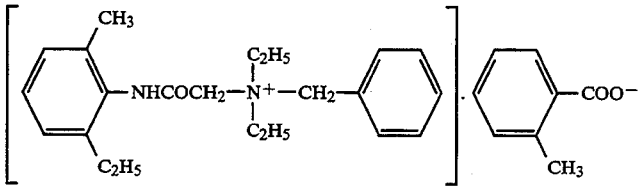

The compounds of the invention represented by Formula (1) can be prepared by the conventional method, and for example, compound I-4 Bitrex (Bitrex TM produced by Macfaran Smith Co.) is also available on the market.

When a p-phenylenediamine color developing agent or a hydroquinone developing agent is in a powder form, the fluidity thereof is poor, and it is preferable that the composition containing at least one of the p-phenylenediamine color developing agent and the hydroquinone developing agent is a solidified processing composition for a silver halide photographic light-sensitive material.

The present invention will be explained in detail below.

The processing composition of the invention for a silver halide photographic light-sensitive material is applied to a color developer of a color light-sensitive material for photographing, a color developer of a color paper light-sensitive material, a developer of a black-and-white light-sensitive material and a developer of a reversal light-sensitive material (film or paper).

The present invention is preferably applied to a color developer or a developer for a black-and-white light-sensitive material.

Since the above developing agents are dangerous compared to any other component if accidentally eaten and drunken, it is preferable that the composition is effective as a vomiting agent.

The tableted solid photographic processing composition of the invention can be obtained by granulating powderd material, and mixing and tableting the granules. For example, a methods described in JP. O.P.I. Publication Nos. 51-61837/1976, 54-155038/1979 and 52-88025/1987 and British Patent No. 1,213,808 can be employed.

In the manufacture of the solid composition of the invention the compound represented by Formula (I) (hereinafter refers to the compound of the invention) may be added thereto before or during pulverizing, before or during granulating, or during tableting. The content of the compound is preferably $5\times10^{-6}$ to 4.0% by weight based on the total weight. The compound of the invention may be localized on the surface of the solid composition. When the compound of the invention is not localized in the solid composition, the content of the compound is preferably 0.005 to 4.0% by weight. When the compound is localized on the surface, the content of $5\times10^{-6}$ by weight gives the effects as a lubricant, a vomiting agent or a fungicide. In view of the effects of the invention, the compound of the invention is preferably localized in the solid composition of the invention. As a method for localizing the compound, a coating method is used.

A coating solution used in order to localize the compound of the invention on the surface of the solid composition comprises a water-soluble polymer or a saccharide. The exemplified compound of the water-soluble polymer or saccharide will be described below.

1. Water-soluble Polymer polyethylene glycol, polyvinyl alcohol, polyvinyl pyrrolidone, polyvinyl acetal, polyvinyl acetate, an aminoalkylmethacrylate copolymer, methacrylic acid-methacrylate copolymer, methacrylic acid-acrylate copolymer, methacrylic acid betaine type polymer 2. Saccharide monosaccharide such as glucose or galactose, disaccharide such as sucrose or dictose, sugar alcohol such as mannitol, sorbitol, or erythritol, pullulan, methylcellulose, ethylcellulose, hydroxypropylcellulose, hydroxypropylmethylcellulose, celluloseacetate phthalate, hydroxypropylmethylcellulose phthalate, hydroxypropylmethylcellulcse acetate succinate, carboxymethylethylcellulose, a dextrin, a starch decomposition compound Of these compound the especially preferable includes a polyethylene glycol having a weight average molecular weight of 2,000 to 20,000, a methacrylic acid-methacrylate copolymer or methacrylic acid-acrylate copolymer (for example, Oidragid produced by Rehmpharma Co., Ltd.), erythritol, maltose, a dextrin or starch decomposition compound (for example, Pineflow or Pinedex produced by Matsutani Kagaku Co., Ltd.) or a methacrylic acid betaine type polymer (for example, Yuka Former produced by Mitsubishi Yuka Co., Ltd.).

The content of the above water-soluble polymer or saccharide (hereinafter refers to a coating material) in a coating layer on the surface of the solid composition is usually 0.05 to 5% by weight, and preferably 0.2 to 2% by weight based on the total weight of the composition. The content excludes the water-soluble polymer or saccharide contained in other than the coating layer. The solid composition of the invention is preferably coated with the coating material on the entire surface.

As a method for coating the surface of the solid composition of the invention there is a method that the composition is immersed in a coating liquid prepared by dissolving or heat-fusing a coating material, coated with the liquid or sprayed with the liquid and dried. Of these methods, the spray coating is especially preferable.

The spray coating will be detailed below.

The coating material is dissolved or dispersed in water, an organic solvent or a mixture thereof to obtain a coating solution. As a coating method a pan coating method is preferably employed. In the pan coating the coating solution is added or sprayed to the surface of the solid composition and dried to have a specific coating amount while rotating the pan containing the solid composition and supplying a hot air. The drying may be carrird out at a reduced pressure. The coating layer may be a multi-layer formed by using not less than two coating solutions. There is another method that the solid composition is placed on the moving belt and the coating solution is sprayed to the composition and dried. When the belt is reticulate, the coating solution is supplied from both upside and underside, and the both upper and lower sides of the solid composition are coated simultaneously. The solid composition moves on the belt from spraying to drying and can be coated continuously. Accordingly, the continuous production of the coated composition is possible.

In the spray-coating method the coating solution preferably contains a plasticizer. The plasticizer includes polyethylene glycol, glycerin ester, sucrose fatty acid ester, castor oil, polyoxyethylenesorbitanester (Trade name Tuin produced by Kao Co., Ltd.), an organic acid ester, a carbitol, a cellosolve, ethylene glycol, propylene glycol or diethylene glycol. These may be added in advance to the coating solution. The preferable exemplified plasticizer will be shown below.

Exemplified plasticizer (1) polyethylene glycol (2) triacetin (3) polyoxyethylensorbitanmonolaurate (Tuin 20 produced by Kao Co., Ltd.) (4) polyoxyethylenscrbitanmonopalmitate (Tuin 40 produced by Kao Co., Ltd.) (5) polyoxyethylensorbitanmonostearate (Tuin 60 produced by Kao Co., Ltd.) (6) polyoxyethylensorbitanmonooleate (Tuin 80 produced by Kao Co., Ltd.) (7) triethyl citrate (8) dibutylphthalate (9) diisopropyl succinate (10) carbitol (11) butylcarbitol acetate (12) dibutylcarbitol (13) ethylcellosolve (14) phenylcellosolve (15) ethylene glycol (16) propylene glycol (17) diethylene glycol Of these compounds (1), (2), (3), (7) and (16) are especially preferable. Polyethylene glycol (1) has preferably a weight average molecular weight of 200 to 10000. The content of the plasticizer in the coating layer is preferably 0.01 to 50% by weight, and more preferably 0.1 to 30% by weight.

The compound of the invention represented by Formula (I) may be used in combination with a water soluble lubricant.

The typical method of dissolving a solid processing composition includes a method of dissolving it in water placed in a replenishing tank and replenishing the resulting solution or a method of directly introducing the agent into the processing tank and dissolving it.

When the processing composition of the invention is supplied in an automatic developing machine, the processing tank is directly replenished with a replenising agent in a predetermined amount or with tablets in one or several pieces when the area of light-sensitive materials to be processed is integrally measured through a detector equipped at the entrance of the light-sensitive materials into the processor and the total area reaches a predetermined value.

The detector for detecting the area of light-sensitive materials may be a conventional micro-switch type, infrared light type or ultrasonic type, as long as it is accurately measured.

As for the method of replenishing solid processing composition, the preferable results are obtained by directly introducing the agent into an automatic developing machine of a processing tank comprised of a processing solution tank, processing circulating tubing, a temperature regulating tank or a processing filter section.

When using processing tablets, it is possible to change the size or form thereof according to the processing tablets. Solid agent units are preferably supplied individually by means of a replenishing mechanism according to signals from the area detector at the top of the aforegoing processing tank, processing circulating tubing, temperature regulating tank or processing solution filter section.

The supplying section of the solid processing composition is preferably modified so that it is not influenced by the temperature of processing sections of the automatic processor or the ambient temperature and solid agents before being suppied do not contact the processing solution splashed by the light-sensitive materials being processed.

The processing solution of the photographic processing composition of the invention and the process using the same will be explained below.

As the preferable process the following is cited, but the process is not limited thereto. (1) color development→bleach-fixing→stabilizing (2) color development→bleaching-fixing→stabilizing (3) color development→bleaching→bleach-fixing→stabilizing (4) color development→bleach-fixing→fixing→stabilizing (5) color development→fixing→bleach-fixing→stabilizing (6) color development→bleaching→bleach-fixing→fixing→stabilizing The processing solution used in the above processes will be explained below. In the explanation the processing solution is referred to a tank solution or a processing solution.

The color developing agent desirably applicable to a color developer is a p-phenylenediamine type compound having a hydrophilic group, because it can excellently display the effects of the invention and can reduce a fog production.

As compared to a paraphenylene diamine type compound not having any hydrophilic group, such as N,N-diethyl-p-phenylene diamine, the p-phenylene diamine type compounds each having a hydrophilic group not only have such an advantage that any light sensitive materials are not contaminated and any human skin is not poisoned even if it adheres to the skin.

The compound includes those in which the foregoing hydrophilic group is positioned at the amino group or the benzene ring of the p-phenylene diamine type compounds. The typical hydrophilic group includes preferably $$-(CH_2)_n-CH_2OH-,$$

$$-(CH_2)_m-NHSO_2-(CH_2)_n-CH_3,$$

$$-(CH_2)_m-O-(CH_2)_n-CH_3,$$

$$-(CH_2CH_2O)_nC_mH_{2m+1}$$

$$-(CH_2)_m-CON\begin{matrix}C_mH_{2m+1}\\C_mH_{2m+1}\end{matrix}$$

wherein m and n are each an integer of 0 to 5, —COOH group and —SO3H group.

The Exemplified compound of the color developing agent preferably used in the invention will be described in detail below.

(Exemplified color developing agent)

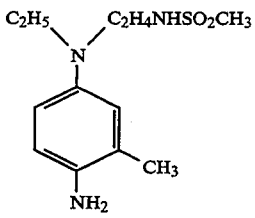

(D-1) $\cdot\frac{3}{2}H_2SO_4.H_2O$

-continued

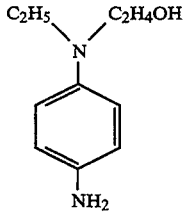

(D-2) $.H_2SO_4$

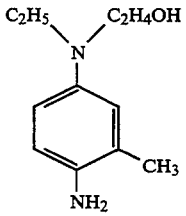

(D-3) $.H_2SO_4$

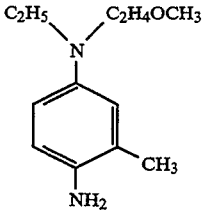

(D-4) $.2CH_3$ 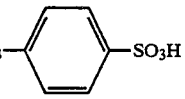

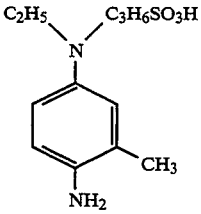

(D-5) $.H_2SO_4$

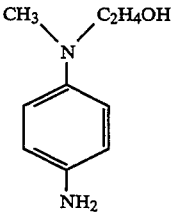

(D-6) $.\frac{1}{2}H_2SO_4$

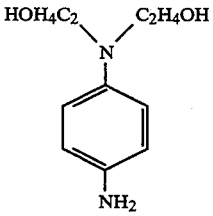

(D-7) $.H_2SO_4$

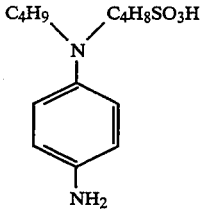

(D-8) $.\frac{1}{2}H_2SO_4$

-continued (D-9)

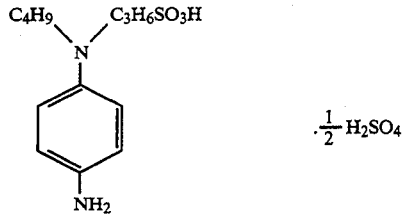

(D-10)

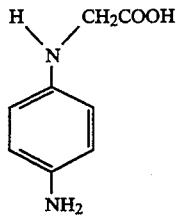

(D-11)

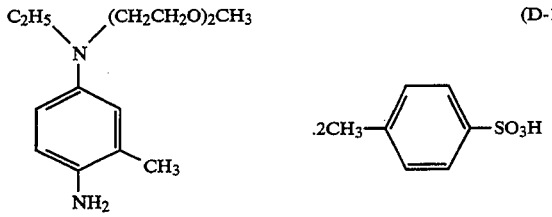

(D-12)

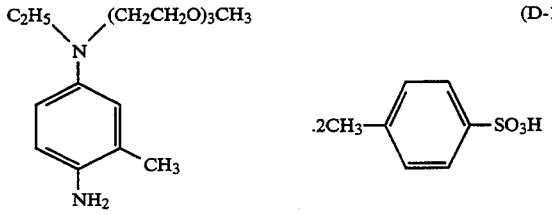

(D-13)

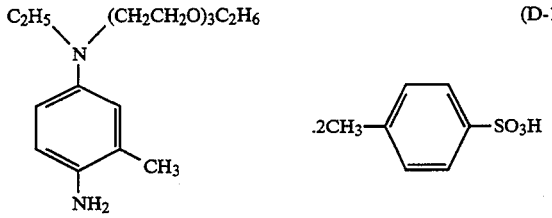

(D-14)

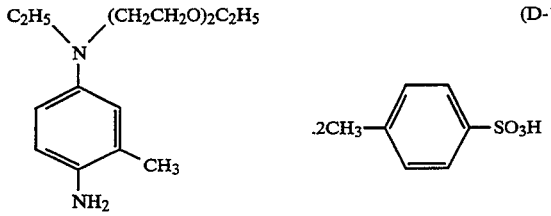

(D-15)

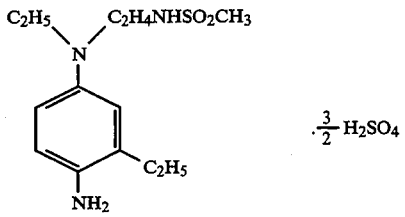

-continued (D-16)

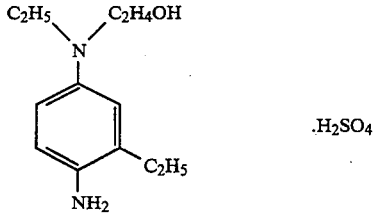

(D-17)

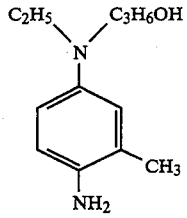

(D-18)

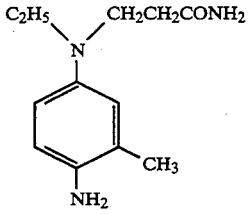

The hydroquinone type developing agents include hydroquinone, methylhydroquinone, chlorohydroquinone, bromohydroquinone, isopropylhydroquinone, 2,3-dichlorohydroquinone, 2,5-dichlorohydroquinone, or 2,3-dimethylhydroquinone.

The more excellent results are obtained when the compound represented by the following Formula (III) is contained in a color developer.

Formula (III)

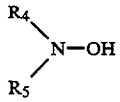

In Formula (III) $R_4$ and $R_5$ independently represent a hydrogen atom, an alkyl group, an aryl group, or

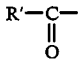

provided that $R_4$ and $R_5$ are not simultaneously hydrogen atoms and the alkyl group represented by $R_4$ and $R_5$ may be the same or the different. $R_3$ and $R_4$ preferably independently represent an alkyl group having 1 to 3 carbon atoms, which may have a carboxyl group, a phosphoric acid group, a sulfonic acid group or a hydroxyl group.

R′ represents an alkoxy group, an alkyl group or an aryl group. The alkyl or aryl group of $R_4$, $R_5$ and R′ includes one having a substituent and $R_4$ and $R_5$ may combine to form a ring or a heterocyclic ring such as piperidine, pyridine, triazine or morphorine.

The typical examples of the hydroxyl amine type compounds represented by the foregoing general Formula (III) are given in U.S. Pat. Nos. 3,287,125, 3,329,034 and 3,287,124. The particularly preferable exemplified compounds include Compounds (I-1) through (I-39) given in JP O.P.I. Publication No. 4-8674/1992, pp.36~38, Compounds (1) through (53) given in JP O.P.I Publication No. 3-33845/1991, pp.3~6, and Compounds (1) through (52) given in JP OPI Publication No. 3-63646/1991, pp.5~7.

The compounds represented by Formula (III) are generally used in the form of a free amine, a hydrochloride, a sulfate, a p-toluene sulfonate, an oxalate, a phosphate or an acetate.

In the color developer a sulfite salt can be used as a preservative, and further a buffering agent can be used.

The development accelerators include, for example; thioether type compounds typified by those given in JP Examined Publication Nos. 37-16088/1962, 37-5987/1962, 38-7826/1963, 44-12380/1969 and 45-9019/1970 and U.S. Pat. No. 3,813,247; p-phenylene diamine type compounds typified by those given in JP OPI Publication Nos. 52-49829/1977 and 15554/1975; quaternary ammonium salts typified by those given in JP Examined Publication No. 44-30074/1969 and JP OPI Publication Nos. 50-137726/1975, 56-156826/1981 and 52-43429/1977; p-aminophenols given in U.S. Pat. Nos. 2,610,122 and 4,119,462; amine type compounds given in U.S. Patent Nos. 2,494,903, 3,128,182, 4,230,796 and 3,253,919, JP Examined Publication No. 41-11431/1966 and U.S. Pat. Nos. 2,482,546, 2,596,926 and 3,582,346; polyalkylene oxides typified by those given in JP Examined Publication Nos. 37-16088/1962 and 42-25201/1967, U.S. Pat. No. 3,128,183, JP Examined Publication Nos. 41-11431/1966 and 42-23883/1967 and U.S. Pat. No. 3,532,501; and, besides the above, a 1-phenyl-3-pyrazolidone, a hydrazine, a mesoionic type compound, an ionic type compound and an imidazole. They may be so added as to meet the requirements.

It is preferable that the color developer does not substantially contain benzyl alcohol.

For the purpose of preventing fog and so forth, chlorine ion and bromine ion may also be applied to a color developer.

When these ions are added directly into a color developer, the chlorine ion supplying materials include sodium chloride, potassium chloride, ammonium chloride, nickel chloride, magnesium chloride, manganese chloride and calcium chloride. Among these materials, sodium chloride and potassium chloride may be preferred. The bromine ion supplying materials include sodium bromide, potassium bromide, ammonium bromide, lithium bromide, calcium bromide, magnesium bromide, manganese bromide, nickel bromide, cerium bromide and thallium bromide. Among these materials, potassium bromide and sodium bromide may be preferred.

They may also be supplied in the form of the counter salts of a fluorescent whitening agent which is to be added into a color developer.

If required, the color developers of the invention are allowed to be further added with any desired antifoggant, in addition to the chloride ion and bromide ion. The antifoggant applicable thereto include an alkali-metal halide such as potassium iodide and an organic antifoggant. The organic antifoggants may be typified by nitrogen-containing heterocyclic compounds including, for example, benzotriazole, 6-nitrobenzoimidazole, 5-nitroisoindazole, 5-methylbenzotriazole, 5-nitrobenzotriazole, 5-chlorobenzotriazole, 2thiazolylbenzo imidazole, 2-thiazolylmethylbenzoimidazole, indazole, hydroxyazaindolidine and adenine.

Triazinyl stilbene type fluorescent whitening agent can be contained in the color developer used in the invention.

Further, an auxiliary developing agent may also be used together with a developing agent. The known auxiliary developing agent include, for example, N-methyl-p-aminophenol hexasulfate (or Metol), Phenidone, N,N-diethyl-p-aminophenol hydrochloride and N,N,N',N'-tetramethyl-p-phenylene diamine hydrochloride.

Still further, a variety of additives such as an antistaining agent, an antisludging agent and an interlayer-effect accelerator may be used therein, besides the above.

From the viewpoint of effectively achieving the objects of the invention, the color developer preferably contains the chelating agent represented by the following Formula (K) and the exemplified compounds K-1 through K-22 given in JP O.P.I. Publication No. 4-118649/1992, p. 69 to p. 74.

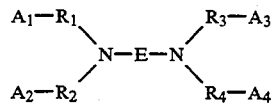

Formula (K)

In carrying out the invention the preferably employed automatic processor and solid agent supplying mechanism described in JP O.P.I. Publication No.5-119454/1993 can be used.

EXAMPLES

The invention will be described in detail in the following Examples, and is not limited thereto.

EXAMPLE 1

A color developer replenishing tablet sample for a color negagative film was prepared according to the following procedures.

Procedure (1)

In a bandamu-mill available on the market 650 g of a color developing agent CD-4 (4-amino-3-methyl-N-ethyl-(β-hydroxyethyl)-aniline sulfate was pulverized to have an average particle size of 10 μm. The resulting fine particles were mixed with 80 g of mannitol and were sprayed with 10 ml of water and were granulated at a room temperature for 7 minutes in a stirring granulator available on the market. Thereafter, the granules were dried at 40° C. for 2 hours in a fluid-bed type drier to completely remove the moisture.

Procedure (2)

In the same manner as in Procedure (1) 360 g of hydroxylamine sulfate, 40 g of potassium bromide and 20 g of disodium disulfocatechol were pulverized and mixed with 20 g of Pineflow (produced by Matsutani Kagakukogyo Co.), and the mixture was granulated by adding 5.0 ml of water thereto. Thereafter, the granules were dried at 60° C. for 1 hour to completely remove the moisture.

Procedure (3)

In the same manner as in Procedure (1) 580 g of sodium sulfite, 3750 g of potassium carbonate and 240 g of pentasodium diethylene-triaminepentaacetate were pulverized. The resulting fine particles were mixed with 500 g of polyethyleneglycol (weight average molecular weight: 6000) and 800 g of mannitol in a mixer available on the market and were granulated by adding 100 ml of water thereto. Thereafter, the granules were dried at 70° C. for 2 hours to completely remove the moisture.

Procedure (4)

The above obtained granules in Procedures (1) to (3) were uniformly mixed for 10 minutes with a mixer in a room of 25° C. and 45% RH. Then, the compounds of the invention or the comparative compounds shown in Table 1 were added in an amount shown in Table 1 and mixed for further 3 minutes.

The resulting mixture was continuously tableted at a rate of 5 r.p.m, making use of a modified rotary tableting machine (Tough Press Correct H18 manufactured by Kikusui Mfg. Works) wherein the loading amount was 12.0 g/tablet, compressing pressure was 1000 kg/cm$^2$ and the diameter of tablet was 30 mm. Thus, color developer replenishing tablet samples for a color negative film were obtained.

Experiment 1

Five tablets obtained in the foregoing Procedures were dissolved in 1 liter of water, and solubility thereof was observed.

Experiment 2

In the foregoing continuous tableting procedures, the tablets were evaluated for tableting properties such as appearance of the tablets and adhesion of the mixture to the tableting machine.

Experiment 3

The mixture granules obtained in the foregoing Procedure were compression-molded, making use of a hydraulic press machine available on the market and a cylindrical die having a diameter of 30 mm wherein the loading amount was 12 g/tablet and the compressing pressure was 1000 kg/cm$^2$. The tablets molded were pressed out and the press-out pressure necessary for forcing the tablets out from the die was measured with a load cell. The measurement was repeated for ten tablets, and the average value thereof was calculated as press-out pressure.

Experiment 4

The hardness through the diameter of 10 tablet samples obtained in the foregoing Procedures was measured by means of a tablet hardness tester (Speed checker produced by Okada Seiko Co., Ltd.), and the average value thereof was calculated.

Experiment 5

One tablet of each of samples obtained in the foregoing Procedure was taken out and fine powder produced on the surface was removed. Then, the tablet was placed in a polystyrene-made box having a size of 45 mm (length)×45 mm (width)×22 mm (height) with a cap and the vibration test was carried out at a vibration rate of 5–67 Hz/210 seconds for 10 minutes and for 3 hours by means of a vibration Tester BF-UA (produced by IDEX Co., Ltd.). Then, powder adhered to the wall in the box was observed.

The results are shown in Table 1.

TABLE 1

| Sample No. | Compounds added | Addition amount (weight %) | Solubility | Tableting property: Appearance of tablets | Tableting property: Adhesion | Pressout pressure (kg) | Hardness of tablets (kg) | vibration test: 10 min. | vibration test: 3 hours | Remarks |
|---|---|---|---|---|---|---|---|---|---|---|
| 1 | None | 0 | A | C | C | 810 | 18 | D | D | Comparative |
| 2 | Magnesium stearate | 0.005 | C | A | A | 520 | 32 | B | B | Comparative |
| 3 | Magnesium stearate | 0.1 | C | A | A | 280 | 23 | A | B | Comparative |
| 4 | Magnesium stearate | 4.0 | C | A | A | 210 | 19 | B | C | Comparative |
| 5 | I-4 | 0.005 | A | B | A | 590 | 35 | B | B | Invention |
| 6 | I-4 | 0.1 | A | A | A | 370 | 48 | A | B | Invention |
| 7 | I-4 | 4.0 | B | A | A | 280 | 56 | A | B | Invention |
| 8 | I-7 | 0.005 | A | B | A | 620 | 31 | B | B | Invention |
| 9 | I-7 | 0.1 | A | B | A | 390 | 44 | B | B | Invention |
| 10 | I-7 | 4.0 | B | A | A | 330 | 47 | B | B | Invention |
| 11 | I-8 | 0.1 | A | B | A | 460 | 35 | B | B | Invention |
| 12 | I-12 | 0.1 | A | B | A | 410 | 38 | A | B | Invention |

Evaluation criterions.

Solubility

A: Neither precipitation nor floating matter was observed.

B: Slight precipitation or floating matter was observed.

C: Much precipitation or floating matter was observed.

Tableting property: Appearance of tablets. B

A: No tablet samples had defects.

B: Five to ten % of the tablet samples had defects.

C: Many of tablet samples had defects.

Tableting property: Adhesion

A: No adhesion of powder to the tableting machine was observed.

C: Adhesion of powder to the tableting machine was observed.

Vibration test

A: No adhesion of fine powder to the wall was observed.

B: Slight adhesion of fine powder to the wall was observed

C: Adhesion of fine powder to the whole of the wall was observed.

D: Adhesion of fine powder to the whole of the wall was observed and fine powder was observed inside the box.

As is apparent from Table 1, in the solid agent not containing the compound of the invention the press-out pressure is high, lubricity is low and tableting properties are poor. Tablets containing magnesium stearate have less press-out pressure and high lubricity, but have poor strength and low solubility. On the contrary, the tablet of the invention exhibits high lubricity, excellent tableting properties, high strength and less occurrence of fine powder on hans port or handling.

EXAMPLE 2

To the granules obtained in the above Procedures (1) to (3) was added 40 g of sodium N-myristoyl-N-methyl- β-alanine and mixed for 10 minutes in the same manner as in Example 1. The resulting mixture was tableted in the same manner as in Example 1 to obtain a tablet sample for a color developer replenisher of a color negative film.

To a 30 weight % solution of a coating agent shown in Table 2, compounds shown in Table 2 were added to have a weight % shown in Table 2 based on the total weight of the tablet and was allowed to stand at 25° C. and 50% RH for a week under an open condition. Thus, a coating solution was obtained.

The tablet sample was sprayed with the coating solution to have a dry coating weight of 1.0 weight % based on the total weight, using Aqua-Coater AQC-48T produced by Furointo Sangyo Co., Ltd. The tablet was heated for 5 minutes supplying an air of 60–65° C. and coated with the coating solution at 15 rpm, at a charge air temperature of 60° C. and at an exhaust air temperature of 35–45° C. to obtain a coated tablet sample for a color developer replenisher of a color negative film.

The tablet sample obtained in the foregoing procedures was allowed to stand at 25° C. and 50 % RH for a day and the surface of the tablet was observed under the following criterions and the vibration test was carried out in the same manner as in Experiment 5.

Evaluation of the Tablet Surface

A: No stains on the surface were observed.

B: Few black-green stains on the surface were observed.

C: Many black-green stains on the surface were observed.

The results are shown in Table 2.

TABLE 2

| Sample No. | Compounds of Formula (I) | Addition amount (weight %) | Coating Agent | Appearance of tablet sample | Vibration Test 10 min. | Vibration Test 3 hours | Remarks |
|---|---|---|---|---|---|---|---|
| 2-1 | None | 0 | PEG 6000 | A | B | C | Comp. |
| 2-2 | None | 0 | Pineflow | C | B | C | Comp. |
| 2-3 | None | 0 | Yuka Former AM-75,510 | A | B | C | Comp. |
| 2-4 | None | 0 | erythritol | C | B | C | Comp. |
| 2-5 | I-4 | $1.0 \times 10^{-6}$ | erythritol | B | B | B | Inv. |
| 2-6 | I-4 | $5.0 \times 10^{-6}$ | erythritol | A | B | B | Inv. |
| 2-7 | I-4 | $5.0 \times 10^{-5}$ | erythritol | A | A | B | Inv. |
| 2-8 | I-4 | $5.0 \times 10^{-3}$ | erythritol | A | A | A | Inv. |
| 2-9 | I-4 | $5.0 \times 10^{-5}$ | PEG 6000 | A | A | A | Inv. |
| 2-10 | I-4 | $5.0 \times 10^{-5}$ | Pineflow | A | B | B | Inv. |
| 2-11 | I-4 | $5.0 \times 10^{-5}$ | Yuka Former AM-75,510 | A | A | A | Inv. |
| 2-12 | I-4 | $5.0 \times 10^{-5}$ | Yuka Former AM-75W | A | A | A | Inv. |

Comp.: Comparative
Inv.: Invention

PEG 6000 refers to polyethylene glycol having a weight average molecular weight of 6000.

Pineflow is a compound produced by Matsutani Kagaku Co., Ltd.

Yuka Former AM-75, -510 and -75W is a compound produced by Mitsubishi Yuka Co., Ltd.

As is apparent from Table 2, the composition of the invention in which the compound represented by Formula (I) was localized on the surface prevents fine powder occurrence and coating unevenness due to a coating solution stored for a long term which is considered a rotten solution, and gives a stable tablet free from stains on its surface. Further, the composition of the invention exhibits the above effects, if the addition of the compound is a little.

EXAMPLE 3

In the same manner as in Procedure (1) of Example 1 650 g of a color developing agent CD-4 (4-amino-3-methyl-N-ethyl-(β-hydroxyethyl)aniline sulfate was pulverized. The resulting fine particles were mixed with the compound of the invention shown in Table 3 in an amount shown in Table 3 and 80 g of mannitol to obtain a granule sample. To a 30 weight % solution of disodium disulfo ethylhydroxylamine, compounds shown in Table 3 were added to have a weight % shown in Table 3 based on the total weight of the granule. Thus, a coating solution was obtained.

The granule sample was sprayed with the coating solution to have a dry coating weight of 1.0 weight % based on the total weight, using a fluid-bed type available on the market, while dried to completely remove the moisture. The resulting granule sample was allowed to stand at 25° C. and 50% RH for 2 weeks and the surface of the granule sample was observed. Further, the granule sample was sieved with a 100 mesh sieve, and 10 g of the sieved granule was placed in a first polystyrene box, and then, was transferred into a second polystyrene box from the first, and further was transferred into the first from the second. This procedure was repeated 5 times and 20 times. Then, the wall of the boxes was observed for adhesion of the fine powder occurred.

The results are shown in Table 3

TABLE 3

| Sample No. | Compounds of Formula (I) | Addition amount (weight %) | Content of the Coating Layer (weight %) | Appearance of the Surface | Transfer Test 5 times | Transfer Test 20 times | Remarks |
|---|---|---|---|---|---|---|---|
| 3-1 | None | 0 | 0 | C | C | C | Comp. |
| 3-2 | I-4 | $5.0 \times 10^{-3}$ | 0 | B | B | B | Inv. |
| 3-3 | I-4 | $5.0 \times 10^{-2}$ | 0 | A | B | B | Inv. |
| 3-4 | I-4 | 0.5 | 0 | A | A | B | Inv. |
| 3-5 | I-4 | 0 | $5.0 \times 10^{-6}$ | B | B | B | Inv. |

TABLE 3-continued

| Sample No. | Compounds of Formula (I) | Addition amount (weight %) | Content of the Coating Layer (weight %) | Appearance of the Surface | Transfer Test 5 times | Transfer Test 20 times | Remarks |
|---|---|---|---|---|---|---|---|
| 3-6 | I-4 | 0 | $5.0 \times 10^{-5}$ | A | A | B | Inv. |
| 3-7 | I-4 | 0 | $5.0 \times 10^{-3}$ | A | A | A | Inv. |
| 3-8 | I-2 | $5.0 \times 10^{-3}$ | 0 | B | B | B | Inv. |
| 3-9 | I-2 | $5.0 \times 10^{-2}$ | 0 | B | A | B | Inv. |
| 3-10 | I-2 | 0.5 | 0 | A | A | B | Inv. |
| 3-11 | I-2 | 0 | $5.0 \times 10^{-6}$ | B | B | B | Inv. |
| 3-12 | I-2 | 0 | $5.0 \times 10^{-5}$ | A | B | B | Inv. |
| 3-13 | I-2 | 0 | $5.0 \times 10^{-3}$ | A | A | B | Inv. |

Comp.: Comparative
Inv.: Invention,

The evaluation criterions of the surface was the same as Example 2, and the evaluation criterions of the transfer test was the same as Experiment 5 of Example 1.

As is apparent from Table 3, the composition of the invention containing the compound of the invention prevents fine powder occurrence and gives a stable solid composition having less loosen fine powder on handling and free from stains on its surface. Further, the compound being localized on the surface wherein the content of the compound is a little, the composition of the invention exhibits the effects of the invention.

Example 4 (A color developer replenishing tablet sample for a color paper)

Procedure (A)

In a bandamu-mill 1500 g of a color developing agent CD-3 (4-amino-3-methyl-N-ethyl-N-β-methanesulfonamidoethyl-aniline sulfate) was pulverized up to have an average particle size of 10 μm. The resulting fine particles were granulated at a room temperature for 5 minutes in a stirring granulator available on the market by spray-adding 50 ml of water thereto. Thereafter, the granules were dried at 40° C. for 2 hours in a fluid-bed type drier to completely remove the moisture.

Procedure (B)

In the same manner as in Procedure (A) 400 g of disulfoethylhydroxylamine disodium salt, 1700 g of sodium p-toluenesulfonate and 300 g of Tinopar SFP (produced by Ciba-Geigy Co.) were pulverized and granulated by spray-adding 60 ml of water thereto. Thereafter, the granules were dried at 50° C. for 2 hours to completely remove the moisture.

Procedure (C)

In the same manner as in Procedure (A) 37 g of sodium sutfite, 3300 g of potassium carbonate, 330 g of pentasodium diethylenetriamine pentaacetate and 340 g of lithium hydroxide monohydrate were pulverized and mixed with 600 g of mannitol and 1000 g of polyethyleneglycol (weight average molecular weight: 6000) using a mixer available on the market.

Then, the mixture was granulated in the same manner as in Procedure (A) by spray-adding 100 ml of water thereto. Thereafter, the granules were dried at 60° C. for 2 hours to completely remove the moisture.

Procedure (D)

To the above obtained granules in Procedures (A) to (C), the compounds of the invention or the comparative compounds shown in Table 2 were added in an amount shown in Table 2 and mixed in the same manner as in Example 1.

The resulting mixture was continuously tableted in the same manner as in Example 1. Thus, color developer replenishing tablet samples for a color paper were obtained.

The above obtained samples were evaluated in the same manner as in Example 1, and the effects of the invention were confirmed.

To the granules obtained in the above Procedures (A) to (C) was added 40 g of sodium N-myristoyl-N-methyl-β-alanine and tableted in the same manner as in Example 2.

The tablet sample was processed in the same manner as in Example 2 to obtain a coated tablet sample for a color developer replenisher of a color negative film. The coated tablet above obtained showed the same effects as one of Example 2.

A coating tablet was prepared in the same manner as in Example 2, except that a coating solution not containing the compound of the invention was coated in an amount of 0.5% by weight and then, a coating solution containing the compound of the invention was coated in an amount of 0.5% by weight. This tablet also showed the same effects as one of Example 2.

EXAMPLE 5

A tablet sample for bleach of a color negative film was prepared according to the following procedures.

Procedure (5)

In the same manner as in Procedure (1) of Example 1 1900 g of ferric 1,3-propanediaminetetraacetic acid ammonium salt monohydrate, 95.0 g of 1,3-propanediaminetetraacetic acid, 860.0 g of potassium bromide, 960 g of succinic acid and 420 g of disodium succinate hexahydrate were pulverized, and 30.0 g of Demol MS (produced by Kao Co., Ltd.) and 15.0 g of mannitol were added thereto and mixed, and the resulting mixture was granulated by adding 90 ml of water thereto. Thereafter, the granules were dried at 60° C. for 120 minutes to completely remove the moisture.

Procedure (6)

To the above obtained granules in the above Procedure (5) was added 50.0 g of β-cyclodextrin and mixed. Thereafter, 50.0 g of sodium N-lauroylsarcosine was added thereto and mixed for 3 minutes. The resulting mixture granules were tableted in the same manner as in Example 2 and the resulting tablet was coated in the same manner as in Example 2.

The coated tablet was evaluated in the same manner as in Example 2 and showed effects slightly inferior to but substantially the same effects as one of Example 2.

EXAMPLE 6

A tablet sample for fixer of a color negative film was prepared according to the following procedures.

Procedure (7)

In the same manner as in Procedure (1) 2500.0 g of ammonium thiosulfate, 160.0 g of sodium sulfite, 20.0 g of sodium carbonate and 20.0 g of disodium ethylenediaminetetraacetate were pulverized and 65 g of Pineflow (produced by Matsutani Kagakukogyo Co.) was added thereto and mixed, and the mixture was granulated by adding 50 ml of water thereto. Thereafter, the granules were dried at 60° C. for 120 minutes to completely remove the moisture.

Procedure (8)

The above obtained granules in the above Procedure (7) and 15 g of sodium N-lauroylsarcosine were mixed for 3 minutes through a mixer in a room of 25° C. and not more than 40% RH. Thereafter, the resulting mixture granules were tableted in the same manner as in Example 2 and the resulting tablet was coated in the same manner as in Example 2.

The coated tablet was evaluated in the same manner as in Example 2 and showed effects slightly inferior to but substantially the same effects as one of Example 2.

EXAMPLE 7

A tablet sample for stabilizer of a color negative film was prepared according to the following procedures.

Procedure (9)

In the same manner as in Procedure (1) 1500.0 g of m-hydroxybenzaldehyde, 40.0 g of Megafac F116 (produced by Dainippon Inki Kagaku Co., Ltd.), 250.0 g of disodium ethylenediamine-tetraacetate and 160.0 g of lithium hydroxide monohydrate were pulverized and 100.0 g of Pineflow was added thereto and mixed, and the mixture was granulated by adding 80 ml of water thereto. Thereafter, the granules were dried at 50° C. for 2 hours to completely remove the moisture.

Procedure (10)

The above obtained granules in the above Procedure (9) were mixed for 3 minutes through a mixer in a room of 25° C. and not more than 40% RH. Thereafter, the resulting mixture granules were tableted in the same manner as in Example (2) to obtain a tablet sample for stabilizer of a color negative film and the resulting tablet was coated in the same manner as in Example 2.

The coated tablet was evaluated in the same manner as in Example 2 and showed effects slightly inferior to but substantially the same effects as one of Example 2.

EXAMPLE 8

A tablet sample for bleach-fixer of a color negative film was prepared according to the following procedures.

Procedure (E)

In the same manner as in Procedure (1) of Example 1 6000.0 g of ammonium ferric diethylenetriaminepentaacetate monohydrate, 300.0 g of diethylenetriaminepentaacetic acid and g of sodium carbonate monohydrate were pulverized and 2000.0 g of polyethylene glycol having a weight average molecular weight of 6000 was added thereto and mixed. The mixture was granulated by adding 200 ml of water thereto. Thereafter, the granules were dried at 60° C. for 3 hours to completely remove the moisture.

Procedure (F)

In the same manner as in Procedure (1) of Example 1, 8000.0 g of ammonium thiosulfate and 2000 g of sodium sulfite were pulverized and 500 g of Pineflow was added thereto and mixed. The mixture was granulated by spraying 150 ml of water thereto. Thereafter, the granules were dried at 60° C. for 120 minutes to completely remove the moisture.

Procedure (G)

The above obtained granules in the above Procedures (E) and (F) was mixed at a room temperature for 10 minutes using a cross-rotary mixer available on the market, and 100 g of sodium N-lauroylsarcosine was added thereto and mixed for 3 minutes were added and mixed for 3 minutes. Thereafter, the resulting mixture granules were tableted in the same manner as in Example (2) to obtain a tablet sample for bleach-fixer of a color negative film and the resulting tablet was coated in the same manner as in Example 2.

The coated tablet was evaluated in the same manner as in Example 2 and showed effects slightly inferior to but substantially the same effects as one of Example 2.

EXAMPLE 9

A tablet sample for stabilizer of a color paper was prepared according to the following procedures.

In the same manner as in Procedure (1) of Example 1, 500.0 g of sodium carbonate monohydrate, 3000.0 g of trisodium 1-hydroxyethane-1,1'-diphosphonate, 150.0 g of disodium ethylenediamine-tetraacetate and 70.0 g of o-phenylphenol were pulverized and 500.0 g of polyethylene glycol having a weight average molecular weight of 6000 was added thereto and mixed, and the mixture was granulated by adding 60 ml of water thereto. Thereafter, the granules were dried at 70° C for 120 minutes to completely remove the moisture. To the thus obtained granules are added 50 g of sodium N-lauroylsarcosine was added and mixed for 3 minutes at 25° C. and not more than 40% RH using a mixer available on the market. Thereafter, the resulting mixture granules were tableted in the same manner as in Example 2 to obtain a tablet sample for stabilizer of a color negative film and the resulting tablet was coated in the same manner as in Example 2.

The coated tablet was evaluated in the same manner as in Example 2 and showed effects slightly inferior to but substantially the same effects as one of Example 2.

Example 10 (Evaluation by an automatic developing machine)

One hundred rolls per day of exposed Konica color negative XG400 film produced by Konica Corporation were continuously processed for 30 consecutive days, using an automatic developing machine with the developer tablets obtained in the same manner as in Example 1 and the processing tablets other than the developer tablets, which are described in Example 2 of JP. OPI. Publication No. 5-119454/1993.

After the continuous processing, Konica color negative film control strip NK-4 was processed and the surface of the film were observed for scratches.

After the continuous processing, the rollers in the processing tanks of the machine were also observed for stains.

Further, the processing tanks were observed for precipitates.

After the continuous processing, exposed Konica Color XG400 film was processed and the processed film was allowed to stand at 40° C. and 80% RH for 30 days and the surface on the emulsion side of the film was evaluated for stains.

The results are shown in Table 4.

TABLE 4

| Processing No. | Compounds added | Addition amount (weight %) | Scrathes on the surface of the film | Stains on the rolls | Precipitates Fixer Temp. | Precipitates Final Stabilizer Tank | Stains on the film surface | Remarks |
|---|---|---|---|---|---|---|---|---|
| 4-1 | None | 0 | ○ | Δ | X | XX | XX | Comparative |
| 4-2 | I-4 | 0.1 | ○ | ○ | ○ | ○ | ◎ | Invention |
| 4-3 | I-5 | 0.1 | ○ | ○ | ○ | ○ | ◎ | Invention |
| 4-4 | I-7 | 0.1 | ○ | ○ | ○ | ○ | ○ | Invention |
| 4-5 | I-8 | 0.1 | ○ | ○ | ○ | ○ | ○ | Invention |
| 4-6 | Magnesium stearate | 0.1 | XX | XXX | XXX | XXX | X | Comparative |
| 4-7 | Magnesium stearate | 0.005 | X | X | X | X | X | Comparative |
| 4-8 | I-4 | 0.005 | ○ | ○ | ○ | ○ | ◎ | Invention |
| 4-9 | I-4 | 4.0 | ○ | Δ | ○ | ○ | ◎ | Invention |

(Evaluation Criterions)

Scratches on the surface of the film

O: No scratches were observed.

X: Many scratches were observed.

Stains on the rollers

O: No precipitates nor adherent matter was observed.

Δ: Few precipitates were observed.

X: Many precipitates were observed.

The more X, the more the precipitates.

Stains on the surface of the film

◎: No stains were observed.

O: Few black stains were observed.

X: Several black stains were observed.

XX: Many black stains were observed and lubricity deteriorated.

It has been proved that the precipitates and stains on the rollers occurred in the case not countering the compound of the invention was different from those in the case containing magnesium stearate the compound of the invention.

As is apparent from Table 4, when the light-sensitive materials were processed using the processing composition of the invention, there are no scratches on the surface thereof, no stains on the rollers of the processing tank and no precipitates in the processing tank.

When the compound of the invention was used in the processing solution and the light-sensitive materials were stored for a long term, there are no stains on the surface of the materials.

EXAMPLE 11

The light-sensitive materials were processed in the same manner as in Example 10, using the tablet samples for processing compositions of a color negative film prepared in the same manner as in Examples 2, 5, 6 and 7 and were evaluated in the same manner as in Example 10. There were no stains on the light-sensitive materials even in use of a small amount of the compound of the invention, and the effects of the invention were obtained.

EXAMPLE 12

The light-sensitive materials were processed in the same manner as in Example 10, using the tablet samples for processing compositions of a color negative film prepared in the same manner as in Examples 2, 5, 6 and 7 and were evaluated in the same manner as in Example 10. There were no stains on the light-sensitive materials even in use of a small amount of the compound of the invention, and the effects of the invention were obtained The exposed Konica Color QA Paper Type A-5 (produced by Konica corporation) were processed at a rate of 7.5 $m^2$ per day for 30 consecutive days, using the tablet samples for processing compositions of a color paper prepared in the same manner as in Examples 4, 8 and 9 and an automatic developing machine described in Example 3 of JP. OPI. Publication No. 5-119454/1993.

After processing, Konica Color QA Paper Type A-5 was further processed and the surface of the paper were observed for scratches. Further, stains on the rollers of the processing tank, precipitates in the processing tank and stains on the light sensitive materials due to a long term storage were evaluated in the same manner as in Example 10. As a result, the same results as Example 10 were obtained, and the effects of the invention were obtained.

What is claimed is:

1. A processing composition for a silver halide photographic light-sensitive material, wherein the composition comprises a photographic processing agent and a compound represented by the following Formula (I):

Formula (I)

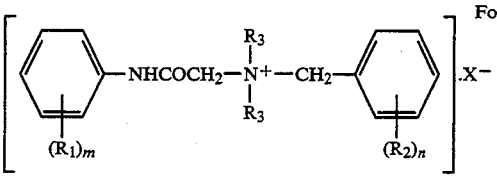

wherein $R_1$ represents a halogen atom, an alkyl group or an alkenyl group, provided that a plural of $R_1$'s may be the same or different; $R_2$ represents a halogen atom, an alkyl group, an alkenyl group or an alkoxy group; $R_3$ represents a lower alkyl group, provided that $R_1$, $R_2$ and $R_3$ may be the same or different, m and n each represent an integer of 0 to 5; and X represents an anion.

2. The processing composition of claim 1, wherein the composition is in a solid form.

3. The processing composition of claim 1, wherein the content of said compound is 0.005 to 4.0% by weight.

4. The processing composition of claim 1, wherein said $R_1$ represents a halogen atom, a methyl group, an ethyl group, a propyl group, a vinyl group or an allyl group, $R_2$ represents a halogen atom, a methyl group, an ethyl group, a propyl group, a vinyl group, an allyl group, a methoxy group, an ethoxy group or a propoxy group, $R_3$ represents an alkyl group having 1 to 3 carbon atoms, said X represents a halogenide ion, a sulfate ion, a nitrate ion, a perchlorate ion, a hydroxy anion or an aliphatic or aromatic carboxylate ion, m represents an integer of 1 or 2, and n represents an integer of 0 or 1.

5. The processing composition of claim 4, wherein said $R_1$ represents a methyl group, an ethyl group or a propyl group, said $R_2$ represents a methyl group, an ethyl group or a propyl group, and said $X^-$ represents an aromatic carboxylate ion.

6. The processing composition of claim 1, wherein said composition is in a granule or tablet form, on which surface said compound is localized.

7. The processing composition of claim 6, wherein the surface of the granule or tablet is coated with a composition comprising one of a water-soluble polymer and said compound represented by Formula (I).

8. The processing composition of claim 1, wherein said photographic processing agent is a p-phenylenediamine compound or a hydroquinone compound.

9. The processing composition of claim 8, wherein said p-phenylenediamine compound has a hydrophilic group which is positioned at the amino group or the benzene ring of the p-phenylene diamine compound.

10. The solid processing agent of claim 9, wherein said hydrophilic group is selected from the group consisting of $-(CH_2)_n-CH_2OH$, $-(CH_2)_m-NH-SO_2-(CH_2)_n-CH_3$, $-(CH_2)_m-O-(CH_2)_n-CH_3$, $-(CH_2CH_2O)_nC_mH_{2m+1}$, $-(CH_2)-CON(C_mH_{2m+1})_2$, $-COOH$ and $-SO_3H$, wherein m and n are each an integer of 0 to 5.

* * * * *